US009234517B2

(12) United States Patent
Wentworth et al.

(10) Patent No.: US 9,234,517 B2
(45) Date of Patent: Jan. 12, 2016

(54) PUMP CONTROL DEVICE, OIL WELL WITH DEVICE AND METHOD

(75) Inventors: Lloyd Wentworth, Anaheim, CA (US); Craig Lamascus, Anaheim, CA (US)

(73) Assignee: HAROLD WELLS ASSOCIATES, INC., Orange, CA (US)

( * ) Notice: Subject to any disclaimer, the term of this patent is extended or adjusted under 35 U.S.C. 154(b) by 824 days.

(21) Appl. No.: 12/605,882

(22) Filed: Oct. 26, 2009

(65) Prior Publication Data

US 2011/0097214 A1 Apr. 28, 2011

(51) Int. Cl.

| | |
|---|---|
| ***F04B 49/02*** | (2006.01) |
| ***F04B 49/06*** | (2006.01) |
| ***F04B 47/02*** | (2006.01) |
| ***F04B 49/10*** | (2006.01) |
| ***F04B 49/12*** | (2006.01) |

(52) U.S. Cl.

CPC ..... *F04B 49/06* (2013.01); *F04B 47/02* (2013.01); *F04B 49/103* (2013.01); *F04B 49/12* (2013.01); *F04B 49/02* (2013.01)

(58) Field of Classification Search

CPC ..... F04B 47/02; F04B 49/12; F04B 49/103
USPC ..... 417/214, 237, 44.1, 45, 411, 904; 318/375, 376; 166/68.5, 105
See application file for complete search history.

(56) References Cited

U.S. PATENT DOCUMENTS

| | | | | |
|---|---|---|---|---|
| 4,490,094 | A * | 12/1984 | Gibbs | 417/42 |
| 4,973,226 | A * | 11/1990 | McKee | 417/18 |
| 5,246,076 | A * | 9/1993 | Watson | 166/369 |
| 5,251,696 | A * | 10/1993 | Boone et al. | 166/250.15 |
| 5,252,031 | A * | 10/1993 | Gibbs | 417/53 |
| 5,281,100 | A * | 1/1994 | Diederich | 417/18 |
| 6,414,455 | B1 | 7/2002 | Watson | |
| 6,497,281 | B2 * | 12/2002 | Vann | 166/250.15 |
| 6,890,156 | B2 * | 5/2005 | Watson et al. | 417/42 |
| 7,330,779 | B2 | 2/2008 | Schultz | |
| 7,785,405 | B2 * | 8/2010 | Manning et al. | 96/112 |
| 2002/0030364 | A1 * | 3/2002 | Bosley et al. | 290/7 |
| 2005/0095140 | A1 | 5/2005 | Boren et al. | |
| 2005/0146221 | A1 | 7/2005 | Pettigrew | |
| 2006/0067834 | A1 | 3/2006 | Boyer et al. | |

(Continued)

OTHER PUBLICATIONS

Weatherford, Rotaflex Long-Stroke Pumping Unit, 2007.
American National Standards Institute, IEEE Recommended Practices and Requirements for Harmonic Control in Electrical Power Systems, Jun. 15, 2004.

(Continued)

*Primary Examiner* — Nathan J Newhouse
*Assistant Examiner* — Christopher Bobish
(74) *Attorney, Agent, or Firm* — Connors & Assoc., P.C.; John J. Connors

(57) ABSTRACT

A method of operating an oil well comprises applying through a variable frequency drive AC electrical energy from a power grid to an AC electric motor to operate a drive mechanism of an oil well pump. The motor speed is regulated in a manner to optimize oil production and maximize the operational life of the drive mechanism, decreasing motor speed by transferring the electrical energy to the power grid and increasing motor speed by transferring the electrical energy from the power grid to the motor. The drive mechanism has a predetermined stroke cycle and, over the course of each stroke cycle, the motor is operated at different regulated speeds initiated when the drive mechanism is at a predetermined position in each stroke cycle.

4 Claims, 10 Drawing Sheets

(56) References Cited

U.S. PATENT DOCUMENTS

| | | | | |
|---|---|---|---|---|
| 2007/0193744 | A1 | 8/2007 | Bridges | |
| 2008/0240930 | A1 * | 10/2008 | Palka et al. | 417/42 |
| 2008/0262857 | A1 | 10/2008 | Perera | |

OTHER PUBLICATIONS

E Production Solutions, E Pac Variable Frequency Drive, Apr. 2008.

PCT/US2010/053981 Intl. Search Report and Written Opinion, Mar. 25, 2010, Lloyd Wentworth, Harold Wells Associates.

* cited by examiner

Fluid Over Pump
Pump Fill - 100%
Pumping Requirement - Maximum SPM

Fluid At Pump
Pump Fill - 50% to 100% (Partial Fill)
Pumping Requirement - Modulate SPM to Maintain Fill

No Fluid (aka Fluid Pound)
Pump Fill - less than 25%
Pumping Requirement - Decrease SPM to increase fluid level

PUMP CONTROL DEVICE, OIL WELL WITH DEVICE AND METHOD

INCORPORATION BY REFERENCE

Any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The words "substantially" and "essentially" have equivalent meanings.

BACKGROUND

In the production of oil a pumping unit is driven by an alternating current (AC) electric motor energized by alternating current from an AC electric power grid to pump oil from the oil well. A well manager unit is used to monitor and regulate the operation of the well in response to conditions in the well. For example, well parameters such as the speed of the motor, the amount of fill of the pump, amount of gas in the well, down-hole well pressure, etc. are monitored and controlled as required. The commonly used rod pumps are a long-stroke pumping unit and a beam pumping unit. In both cases, it is necessary to regulate the speed of the electric motor to avoid creating compression of the pumping unit's rod or otherwise damaging equipment. This may require braking to slow the motor speed and then increasing the motor speed, depending on the position of the rod during the course of each stroke cycle. Each stroke cycle includes an upstroke to a predetermined top rod position where the direction of movement of the rod reverses and begins a downstroke until the rod reaches a predetermined bottom rod position. Then the rod's upstroke is again initiated. Normally braking is accomplished by directing excess electrical energy through resistors that dissipate this electrical energy as heat to the surrounding environment. This, however, is a fire hazard. It is also a waste of electrical energy.

This background discussion is not intended to be an admission of prior art.

SUMMARY

We have invented a method and control device for operating an oil well, and an oil well using our control device, that overcomes the problems of fire hazard and energy waste associated with conventional methods and control devices. Moreover, higher yields may be obtained from an oil well using our method and device than would be achieved otherwise. Our method and control device for operating an oil well, and an oil well using our control device, has one or more of the features depicted in the embodiments discussed in the section entitled "DETAILED DESCRIPTION OF SOME ILLUSTRATIVE EMBODIMENTS." The claims that follow define our method and control device for operating an oil well, and an oil well using our control device, distinguishing them from the prior art; however, without limiting the scope of our method and control device for operating an oil well, and an oil well using our control device, as expressed by these claims in general terms, some, but not necessarily all, of their features are:

One, our oil well includes a pump having a drive mechanism operably connected to an AC electric motor powered by AC electrical energy from a power grid, and a variable frequency AC drive that controls the AC electrical energy applied to the motor to decrease motor speed by transferring the electrical energy to the power grid and to increase motor speed by transferring the electrical energy from the power grid to the motor. The variable frequency AC drive is programmed to regulate the motor speed in a manner to optimize oil production and maximize the operational life of the drive mechanism.

Two, in our oil well a rod of the pump is driven through a predetermined stroke cycle and a signal generator provides a signal when the rod is at a predetermined position in the stroke cycle of the rod, for example, at the end of the downstroke. The variable frequency drive regulates the instantaneous velocity of the motor based on a calculated position of the rod over the course of each stroke cycle. The calculation is initiated when the rod is at said predetermined position as indicated by said signal, for example, at the end of the downstroke. The instantaneous velocity is regulated over the course of each stroke cycle, increasing and decreasing the motor speed to maximize oil production and minimize tension in the rod on the upstroke and maximize tension in the rod on the downstroke.

Three, the variable frequency drive includes a microprocessor that calculates rod position throughout the entire stroke cycle according to the equation $$X=K\int_0^{T_o} V dt$$

where

X=rod position based on percent of cycle (0 to 100%)

V=motor speed (instantaneous revolutions per minute (rpm)

K=scaling constant, $T_o$=time at which "end of stroke" signal is received.

Four, the AC electrical motor moves the rod through a stroke cycle having an upstroke and a downstroke, and it is operably connected to the rod through a mechanism that rotates a known number of revolutions with each stroke cycle. A first sensor provides an end of stroke signal each time the rod is at an end of the downstroke during each stroke cycle. A well manager control unit controls the operation of the oil well in response to conditions of the oil well and provides for each stroke cycle a speed signal corresponding to an optimum average motor speed to maximize oil production under the then present well conditions. The AC drive includes a microprocessor with an input at which the speed signal is received and an input at which the end of stroke signal is received. For each individual oil well using our control device, the microprocessor is programmed so that optimization of oil production and maximum operational life of the drive mechanism is achieved. Specifically, the microprocessor is programmed to drive the electrical motor over the course of each stroke cycle at different speeds as a function of a calculated the rod position, decreasing the motor speed by transferring electrical energy to the power grid and increasing the motor speed by transferring electrical energy from the power grid to the motor.

Five, the microprocessor's program varies the instantaneous velocity of the motor based on (i) the speed signal and (ii) a calculated position of the rod over the course of each stroke cycle, increasing and decreasing the motor speed to maximize oil production and minimize tension in the rod on the upstroke and maximize tension in the rod on the downstroke. The calculation of the rod position is initiated each time the "end of stroke" signal is received. Also, the microprocessor's program sets the motor at a predetermined minimum speed whenever (a) the calculated rod position indicates a rotation greater than the known number of revolutions and (b) the "end of stroke" signal has not been received. After setting the motor speed at the predetermined minimum speed, and once again receiving the "end of stroke" signal, the microprocessor's program varies the instantaneous velocity of the motor based on (i) the speed signal and (ii) a calculated rod position. A second sensor may be used that monitors tension in the rod and provides a tension signal corresponding to the measured tension. The microprocessor may have an input that receives the tension signal and is programmed to take into account the measured tension.

Six, our control device may include a circuit that controls the waveform of the input AC current to reduce low order harmonic current drawn from the power grid. One embodiment includes IGBT transistors that are switched on and off in such a manner that results in current flow and voltage that is substantially sinusoidal. This embodiment may include an inductive and capacitive filter that reduces harmonic voltage distortion caused by switching a converter circuit directly to the input AC current.

Seven, our method of operating an oil well comprises the steps of (a) applying through a variable frequency drive AC electrical energy from a power grid to an AC electric motor operating a drive mechanism of a pump that pumps oil from the well, and (b) regulating the motor speed in a manner to optimize oil production and maximize the operational life of the drive mechanism, decreasing motor speed by transferring the electrical energy to the power grid and increasing motor speed by transferring the electrical energy from the power grid to the motor.

The drive mechanism has a predetermined stroke cycle and, over the course of each stroke cycle, the motor is operated at different regulated speeds initiated when the drive mechanism is at a predetermined position in each stroke cycle.

These features are not listed in any rank order nor is this list intended to be exhaustive.

DESCRIPTION OF THE DRAWING

Some embodiments of our method and control device for operating an oil well, and an oil well using our control device, are discussed in detail in connection with the accompanying drawing, which is for illustrative purposes only. This drawing includes the following figures (Figs.), with like numerals indicating like parts.

DETAILED DESCRIPTION OF SOME ILLUSTRATIVE EMBODIMENTS

Figure 1:
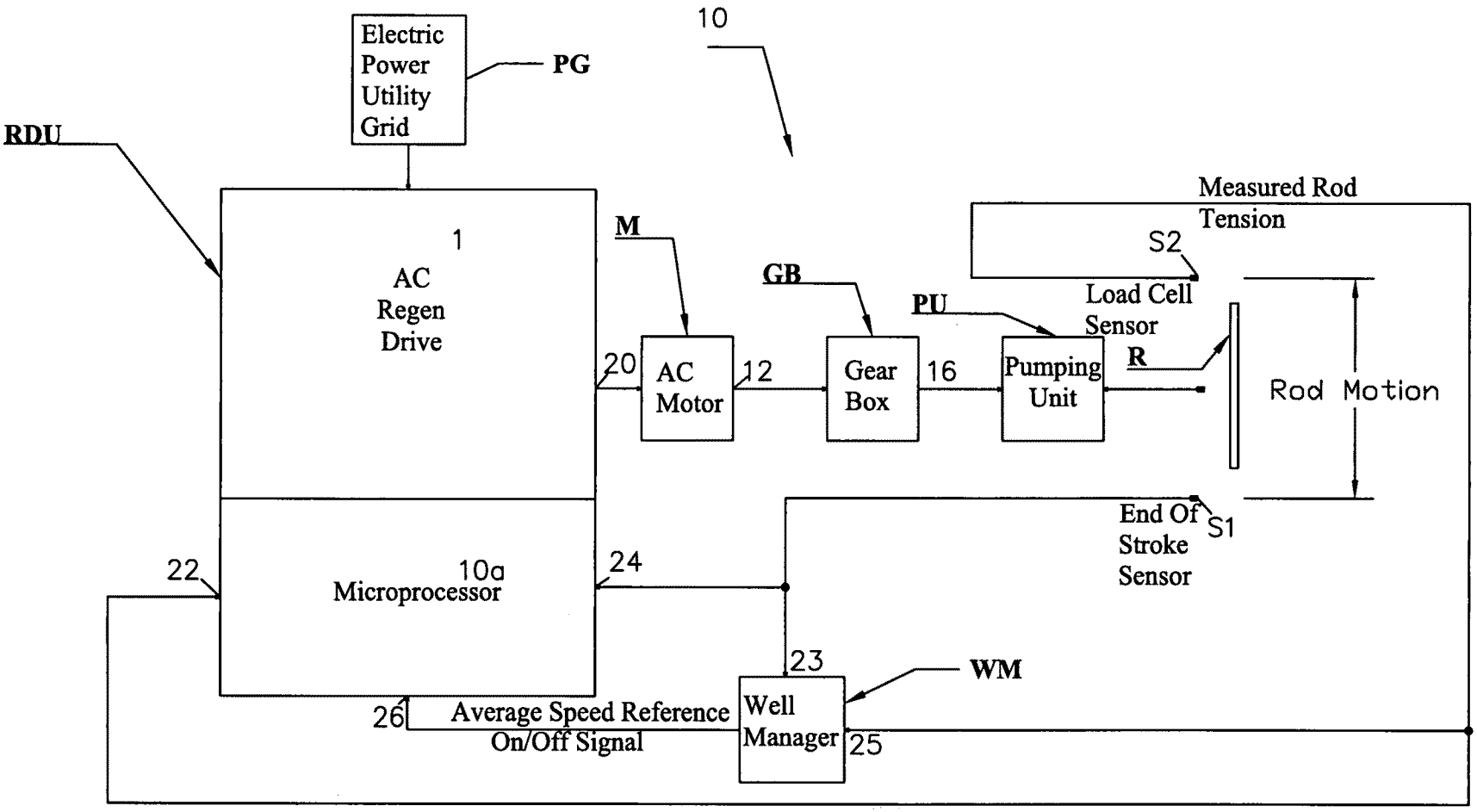
FIG. 1 is a schematic diagram depicting our control device and method of operating an oil well.
Figure 4A:
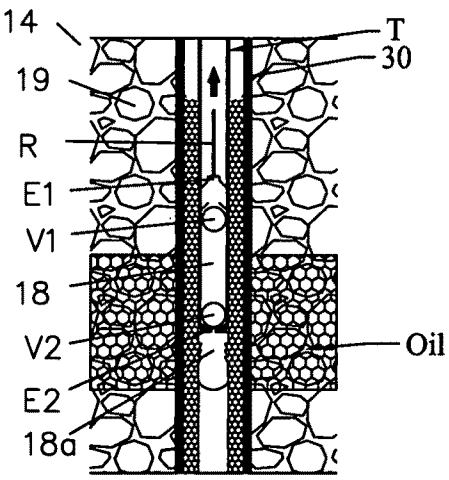
FIG. 4A is an enlarged cross-sectional view of the downhole position of the end of the rod with the oil level above the rod's end.
Figure 4B:
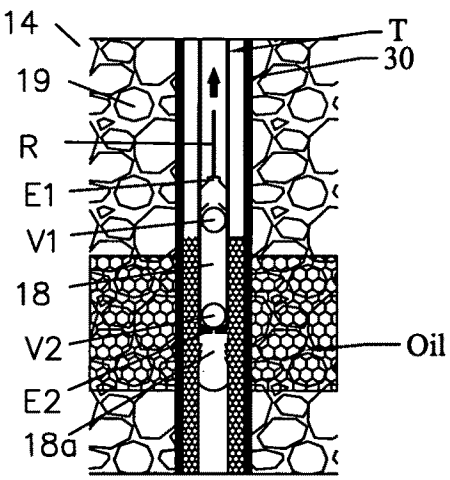
FIG. 4B is an enlarged cross-sectional view similar to that of FIG. 4A with the relationship between the rod's end and the oil level such that maximum oil production is achieved.
Figure 4C:
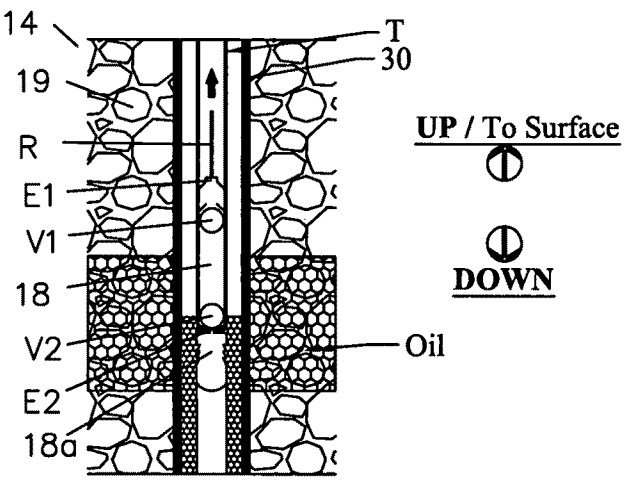
FIG. 4C is an enlarged cross-sectional view similar to that of FIG. 4A showing the oil level below the rod's end.

As shown best in FIG. 1, one embodiment of our control device designated by the numeral 10 controls the operation of a pumping unit PU of an oil well 14 (FIGS. 4A through 4C). Our control device 10 includes an AC regenerative drive unit RDU, which is a conventional apparatus such as, for example, sold by ABB OY DRIVES of Helskinki Finland, under the designation ACS800-U11-0120-5. In accordance with our method, the AC regenerative drive unit RDU includes a microprocessor 10*a* programmed to transfer electrical energy to and from an AC power grid PG in a manner to optimize oil production and maximize the operational life of the pumping unit PU. The AC regenerative drive unit RDU is operatively connected to an AC electric motor M that drives the pumping unit PU. The number of strokes per minute (SPM) of the pumping unit PU is increased or decreased as determined by a conventional well manager unit WM, for example, sold by Lufkin Automation of Houston, Tex., USA, under the designation SAM™ Well Manager.

Figures 3A, 3B, 3C, 3D:
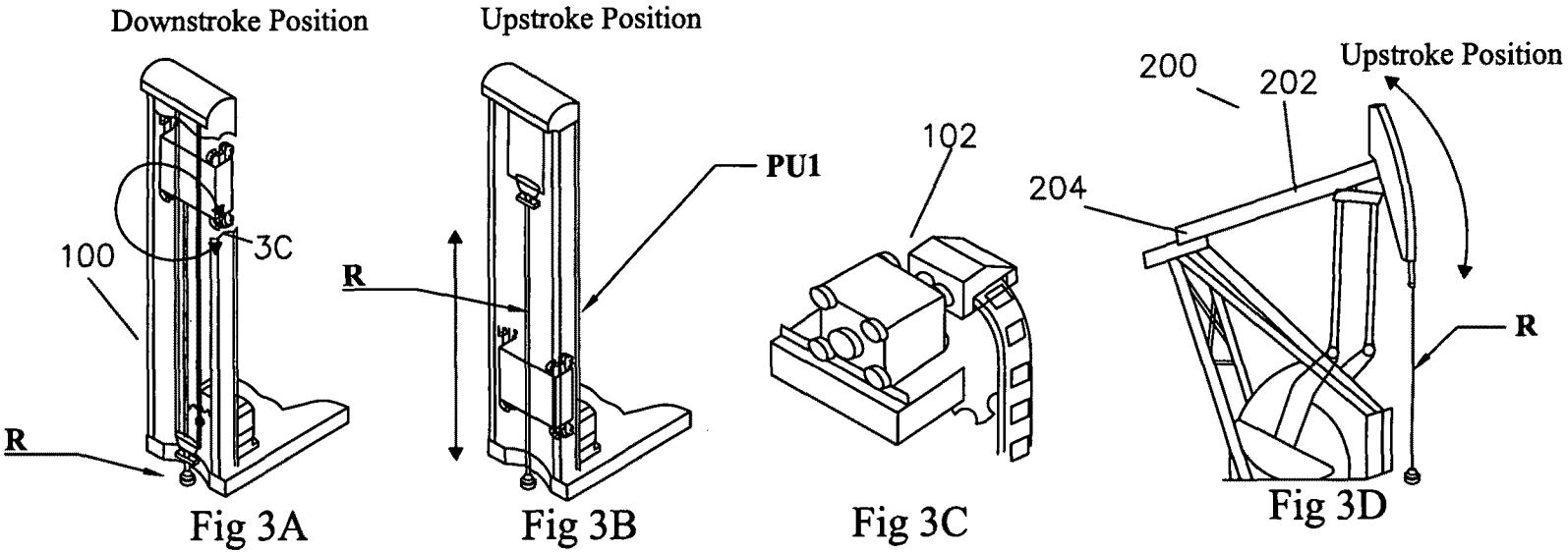
FIG. 3A is a perspective view of a conventional long-stroke pumping unit with its rod at the end of the rod's downstroke.
FIG. 3B is a perspective view of the conventional long-stroke pumping unit shown in FIG. 3A with its rod at the end of the rod's upstroke.
FIG. 3C is a perspective view taken along line 3C of FIG. 3A showing the mechanical clutch of the long-stroke pumping unit.
FIG. 3D is a perspective view of a conventional beam pumping unit

The pumping unit PU may be, for example, a long-stroke pumping unit 100 (FIGS. 3A, 3B, and 3C) or a beam pumping unit 200 (FIG. 3D). Both have a rod R that extends below ground level into the well formation 19. In the long-stroke pumping unit 100 the direction of movement of its rod R is reversed by a mechanical clutch 102 (FIG. 3C). In the beam pumping unit 200 the direction of movement of its rod (not shown) is reversed as its lever arm 202 pivots about a pivot mechanism 204 (FIG. 3D). The embodiment illustrated in FIGS. 3A through 3C, and 5A and designated by the numeral 11*a* shows our control device for the long-stroke pumping unit 100. The embodiment illustrated in FIGS. 3D, and 5B and designated by the numeral 11*b* shows our control device for the beam pumping unit 200. The microprocessor 10*a* is programmed differently in these two embodiments as discussed subsequently in greater detail.

The AC electric motor M has a drive shaft 12 operatively connected to a gearbox GB having its drive shaft 16 operating a drive mechanism of the pumping unit PU to pump oil from the well 14. As illustrated in FIGS. 4A through 4C, the drive mechanism for both the long-stroke unit 100 and beam pumping unit 200 includes a rod R having a terminal end attached to an upper end E1 of a pump chamber 18 having inlet orifices 18*a* at the pump chamber's lower end E2. Within the pump chamber 18 is a pair of spaced apart check valves V1 and V2, respectively near the ends E1 and E2. The pumping unit PU cycles through one entire stroke as determined by the ratio of the gears in the gearbox GB and motor revolutions. For example, 815 revolutions of the motor drive shaft 12 equals one stroke cycle. The AC regenerative drive unit RDU provides a variable frequency and voltage current that varies the instantaneous velocity of the motor M over the course of each cycle of the pumping unit PU as this unit moves through a single stroke cycle. Since the gearbox GB rotates through a known and fixed number of rotations, which can be measured in degrees of rotation, with each stroke cycle, the position of the rod R may be calculated over the course of each stroke cycle. Namely, at 0° the rod is at the beginning of the stroke cycle (0% of cycle), at a known and fixed number of rotations, which can be measured in degrees of rotation, the rod is at the end of the stroke cycle (100% of cycle, for example, the end of the downstroke of the rod R). Half this known and fixed number of rotations, the pumping unit is half way through its cycle (50% of cycle), etc.

Figure 2A:
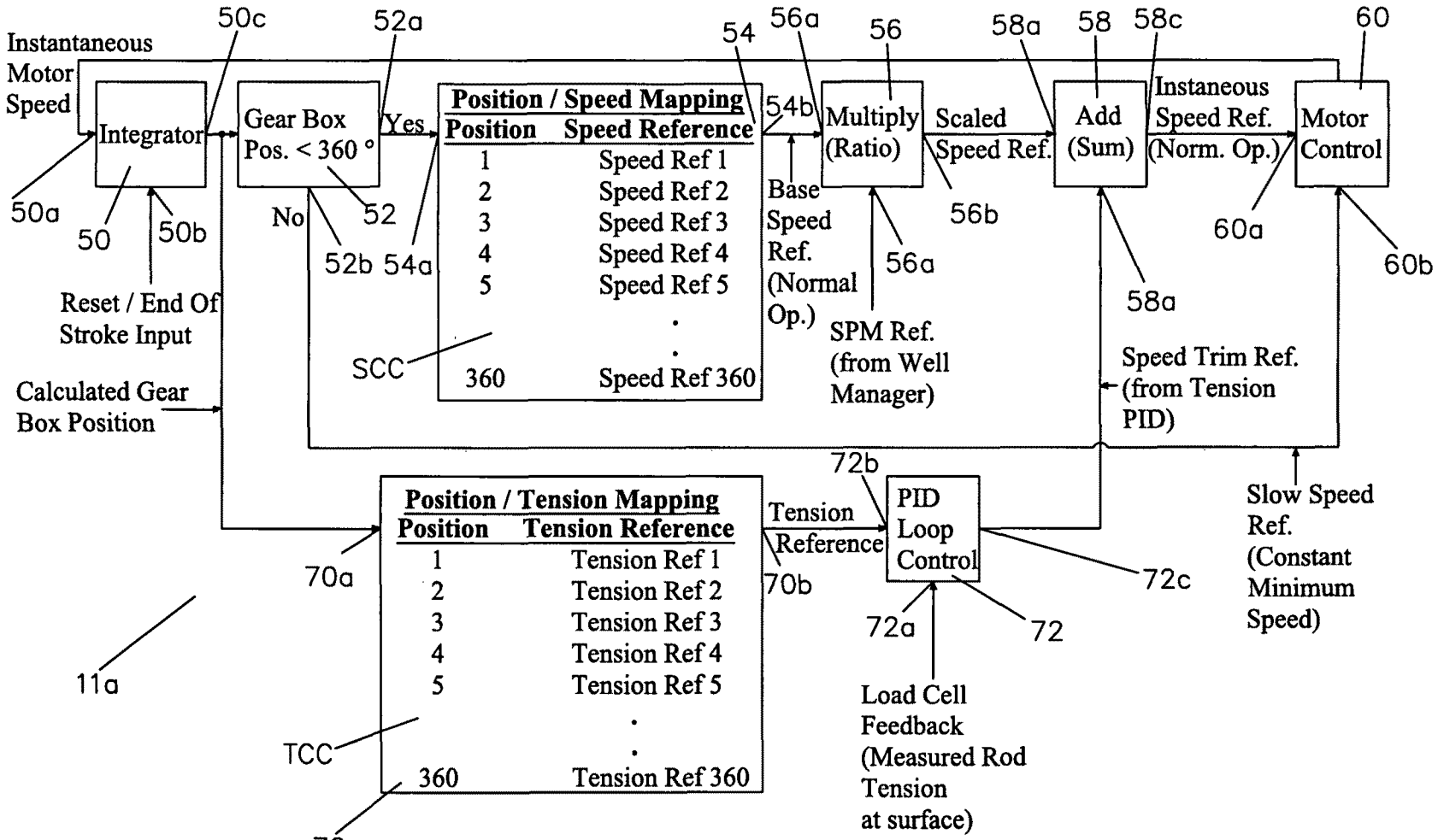
FIG. 2A is a diagram depicting the function of a microprocessor of a regenerative AC drive unit programmed to operate a pumping unit that includes tension monitoring.
Figure 2B:
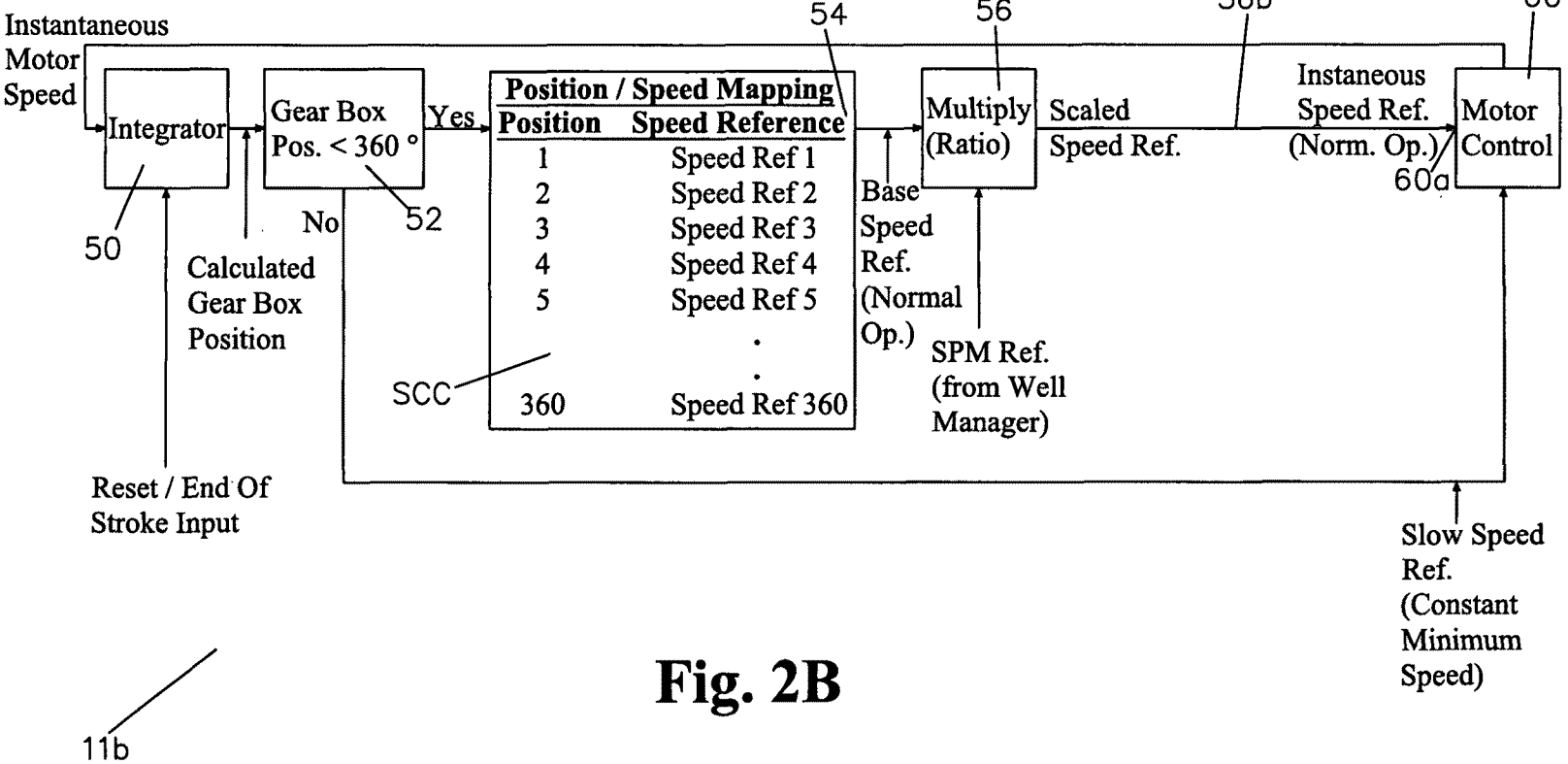
FIG. 2B is a diagram depicting the function of a microprocessor of a regenerative AC drive unit programmed to operate pumping unit that does not include tension monitoring.
Figure 2C:
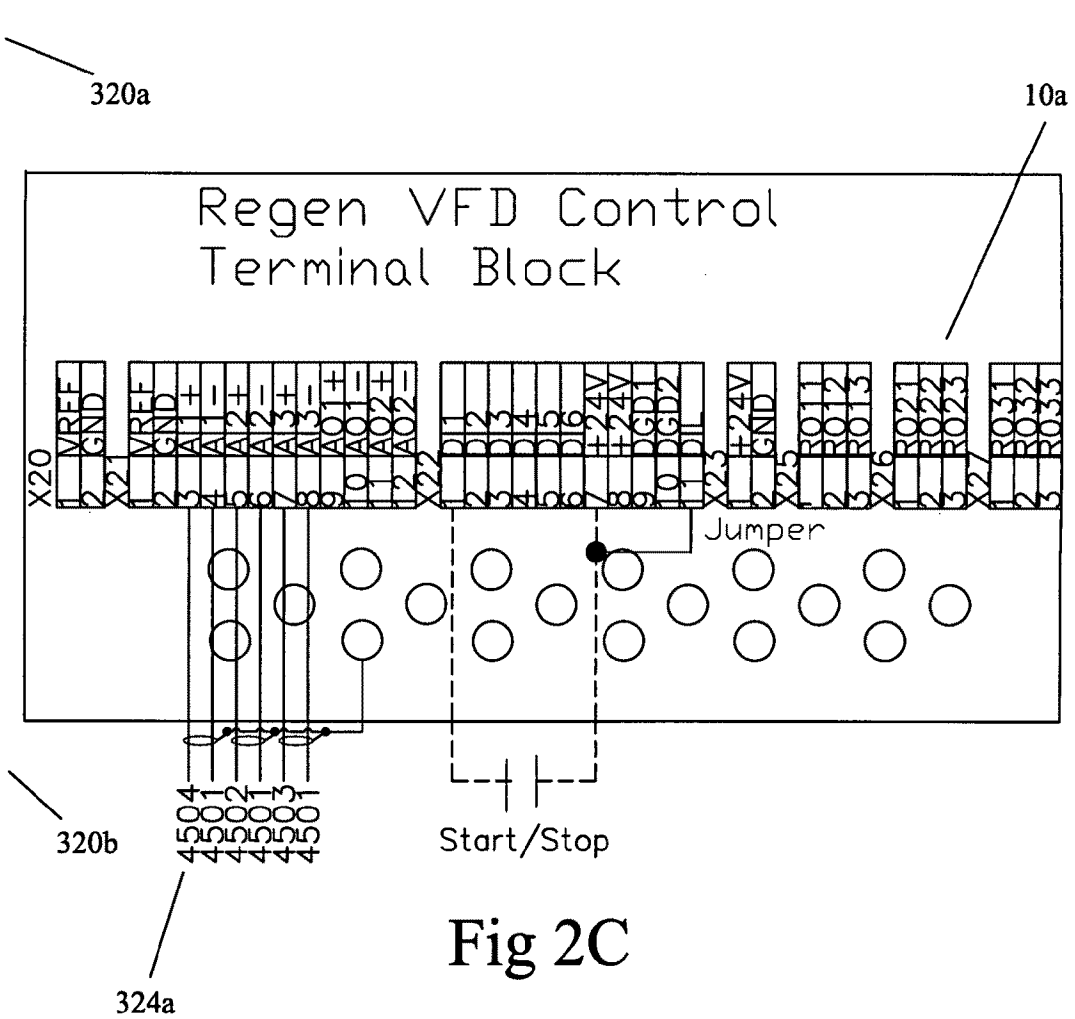
FIG. 2C is an enlarged diagram showing the terminal connections between the microprocessor and other components of the control circuit depicted in FIGS. 6A, 6B and 6C.

In accordance with our method, regardless of the type of pumping unit PU employed, long-stroke or beam, there is a sensor S1 that functions as a location detector. The sensor S1 detects when the rod R is at a predetermined position in the stroke cycle and provides a signal each time the rod is at this predetermined position, for example, at the end of the downstroke and provides a signal (herein the "end of stroke" signal). This "end of stroke" signal is sent to an input 23 of the well manager unit WM and an input 24 of the microprocessor 10*a* of the AC regenerative drive unit RDU. Optionally, a second sensor S2 may be deployed to detect predetermined rod conditions. For example, the sensor S2 may be a load cell that detects the surface tension in the rod R and sends a signal (herein "tension" signal) to an input 25 of the well manager unit WM and to an input 22 of the microprocessor 10*a* of the AC regenerative drive unit RDU. Tension monitoring and control may be used with either a long-stroke or beam pumping unit. FIG. 2A illustrates the embodiment using tension monitoring and control and FIG. 2B illustrates the embodiment without such tension monitoring and control.

The well manager control unit WM is used to monitor and control well parameters in accordance with conventional procedures. For example, when the pump chamber 18 is completely filled, or the amount of fill is above the desired fill as illustrated in FIG. 4A, the well manager unit WM, which is in communication with the microprocessor 10*a*, sends a signal (herein "speed" signal) to the AC regenerative drive unit RDU to increase the motor's average speed (rpm's), or maintain the motors average speed in the case when the motor is already operating at its maximum average speed. And, when the pump chamber 18 is only partially filled (less than 25%), as illustrated in FIG. 4C, the "speed" signal sent to the AC regenerative drive unit RDU indicates a decrease in the motor's average speed (rpm's). Ideally, the "speed" signal corresponds to an optimum average motor speed to maximize oil production under the then present well conditions. The "end of stroke" signal indicates that the rod R is in a predetermined position that is the same for each stroke cycle. The "tension" signal may be applied to the microprocessor's input 22 and the microprocessor 10*a* may be programmed to take into account the measured tension indicated by the "tension" signal to minimize tension in the rod R on the upstroke and maximize tension in the rod on the downstroke.

For each stroke cycle the well manager control unit WM designates what the average speed of the pumping unit PU should be over the course of an individual stroke cycle, mainly ranging substantially from 600 to 1200 rpm. The well manager unit WM may, with each cycle, change the "speed" signal to either increase or decrease the average motor speed or maintain the average speed as previously established. The microprocessor 10*a* is programmed to respond to the "speed" signal from the well manager unit WM to control the instantaneous motor speed in an optimum manner. In other words, over the course of each stroke cycle at different calculated rod positions, the motor M is operated at regulated different instantaneous velocities (speed mapping) initiated when the drive mechanism is at a predetermined position in each stroke cycle, typically at the end of the downstroke of the rod R, as indicated by the "end of stroke" signal. Upon receiving the "end of stroke" signal, the "speed" signal from the well manager unit WM is applied to an input 26 of the microprocessor 10*a* to initiate regulating the instantaneous motor velocity in accordance with a predetermined speed map for the then present well conditions.

During each stroke cycle, the AC regenerative drive unit RDU converts input AC current from the AC power grid PG that is at a standard frequency and voltage to a variable AC current having different frequencies and voltages as established by the program of the microprocessor 10*a*. The microprocessor 10*a* controls the operation of the AC regenerative drive unit RDU by applying the variable AC current to the motor M at an output 20 to decrease instantaneous motor velocity, transferring electrical energy to the power grid PG, and to increase instantaneous motor velocity, transferring electrical energy from the power grid to the motor. Based on pre-established parameters, for example, the type of well, conditions of the oil well, the set point (percent fill) for filling the chamber 18, the "speed" signal indicates for each stroke cycle whether to (1) increase or decrease the average motor speed or (2) maintain the average motor speed as is. Referring to FIG. 4B, at the end of the stroke cycle the valve V2 is open so oil flows into the pump chamber 18. On initiation of the upstroke of the rod R the open valve V2 closes and the valve V1 opens. As the rod R continues to move up, the oil in the chamber 18 flows from the chamber through the open valve V1 into tubing T surrounded by the well's casing 30. When the rod R reverses its direction of movement at the transition between the upstroke and downstroke, the valve V1 closes and the valve V2 opens. At the end of the rod's downstroke, the open valve V2 again allows the oil in the formation 19 and under pressure to fill the pump chamber 18.

In accordance with our method, the microprocessor 10*a* is programmed to control the motor's instantaneous velocity (V) over the course of each stroke cycle as established by a speed map provided by the microprocessor's program. The speed maps are different as determined by the type of pumping unit PU our control device 10 is controlling. Over the course of each stroke cycle initiated each time the "end of stroke" signal is received by the microprocessor 10*a*, the microprocessor's program modulates the frequency and voltage of the variable output AC current at the output 20. This frequency and voltage is modulated as a function of (i) a signal (herein "instantaneous velocity" signal) provided by a motor controller 60 (FIGS. 2A and 2B) of the microprocessor 10*a* and (ii) a calculated rod position. The rod position is calculated according to the equation $$X=K\int_0^{T_o} V dt$$

where

X=rod position based on percent of cycle (0 to 100%)

V=motor speed (instantaneous revolutions per minute (rpm)

K=scaling constant, $T_o$=time at which the "end of stroke" signal is received.

By rapidly increasing and decreasing the motor's instantaneous velocity, yet maintaining the average motor speed set by the well manager unit WM, the yield of oil from many oil wells may be increased without damage to the pumping unit. Increases in yield vary depending on the type of well, pumping unit, and other factors, but increases have been substantially from 10% to 20% percent. It is important that the speed of the motor M be carefully controlled to avoid damage to the rod R or other components of the pumping unit PU, especially during the transition between the downstroke and upstroke and the transition between the upstroke and downstroke. In general for long-stroke pumping units, at the start of the upstroke, the motor's speed in increased, then at about midway through the cycle, the motor's speed is decreased until the transition between the upstroke and downstroke occurs. After this first transition, the motor speed in increased until the transition between the downstroke and upstroke occurs. For example, when the well manager unit WM indicates that the chamber 18 is set to be filled to approximately 85% capacity (FIG. 4B), the "speed" signal will indicate increasing the average speed if chamber is actually filled to 100% capacity as shown in FIG. 4A and will indicate decreasing the average speed if chamber is actually filled to less than 85% capacity as shown in FIG. 4C. When the well manager unit WM indicates that the chamber 18 is at approximately 85% capacity as shown in FIG. 4B, the "speed" signal indicates that the average speed should remain the same under the present well conditions.

The microprocessor's operation for the long-stroke pumping unit 100 and for the beam pumping unit 200 are as follows:

Long-Stroke Pumping Unit

The microprocessor 10*a* for a long-stroke pumping unit, as depicted FIG. 2A, includes a speed control circuit SCC and a tension control circuit TCC. The speed control circuit SCC includes an integrator 50, a comparator 52, a position/speed map 54, a multiplier 56, an adder 58, and the motor controller 60. The comparator 52 has an input 52*c* connected to an output 50*c* of the integrator 50, an output 52*a* connected to an input 54*a* of the position/speed map 54, and an output 52*b* connected to an input 60*b* of the motor controller 60. The position/speed map 54 has an output 54*b* connected to an input 56*a* of the multiplier 56, which has an output connected to an input 58*a* of the adder 58. An output of the adder 58 is connected to an input 60*a* of the motor controller 60, and the adder 58 applies a "scaled instantaneous speed reference" signal to the input 60*a* of the motor controller 60.

In this embodiment an optional tension control circuit TCC may be used, but is not required. The tension control circuit TCC includes a position/tension map 70 and a proportional integral derivative (PID) loop controller 72 having an input 72*a* at which the "tension" signal from the sensor S2 is applied. The position/tension map 70 has an input 70*a* connected to an output 50*c* of the integrator 50 and an output 70*b* connected to an input 72*b* of the integral derivative loop controller 72. The PID loop controller 72 has an output 72*c* connected to an input 58*a* of the adder 58. The signal at the input 60*a* of the motor controller 60 from adder 58 is thus a function of both the tension in the rod R and the calculated position of the rod based on the instantaneous velocity of the motor M over the course of a single stroke.

The motor controller 60 is a component of the AC regenerative drive unit RDU that interacts with other components of the AC regenerative drive unit RDU to govern the frequency and voltage of the AC current at the regenerative drive unit's output 20. In response to the signals at the motor controller's inputs 60*a* and 60*b* (and other pre-established parameters of the AC regenerative drive unit RDU), the instantaneous velocity (V) of the motor M is increased and decreased over the course of each stroke cycle in accordance with a "speed map" that is determined by the "instantaneous velocity" signal applied to the input 50*a* of the integrator 50 and initiated upon applying to the input 50*b* of the integrator the "end of stroke" signal from the sensor S1. The "instantaneous velocity" signal applied to the input 50*a* of the integrator 50 indicates the actual instantaneous motor velocity (V).

Upon the "end of stroke" signal being applied to the input 50*b* of the integrator 50, the integrator 50 starts calculating the rod position X. At the same time, the "speed" signal from the well manager unit WM is applied to the multiplier's input 56*a*. When microprocessor's integrator 50 calculates that the stroke cycle has reached 100%, another "end of stroke" signal should be applied to the input 50*b* of the integrator 50 to indicate that another individual stroke cycle is to begin. This again initiates the operation of the integrator 50 that once again recalculates the rod position X over the course of the next individual stroke cycle. In other words, each time the "end of stroke" signal is applied to the input 50*b*, a speed map is generated for that individual stroke cycle. Failure to receive an end of the stroke signal by the time the integrator 50 calculates that 100% of the stroke cycle has been completed, results in the comparator 52 discontinuing signaling the position/speed map 54 and applying via the output 52*a* a "low speed" signal that indicates to the motor controller 60 to operate the motor at a constant safe speed that avoids damage to the pumping unit PU. The pumping unit PU is maintained at this constant safe low speed until an "end of stroke" signal is again applied to the input 50*b* of integrator 50. Thus, the microprocessor 10*a* is programmed to operate the motor M at a predetermined minimum safe speed whenever the "end of stroke" signal is not received by the time the gearbox GB has completed a known number of revolutions measured in degrees that corresponds to one complete rod stroke cycle.

Figure 5A:
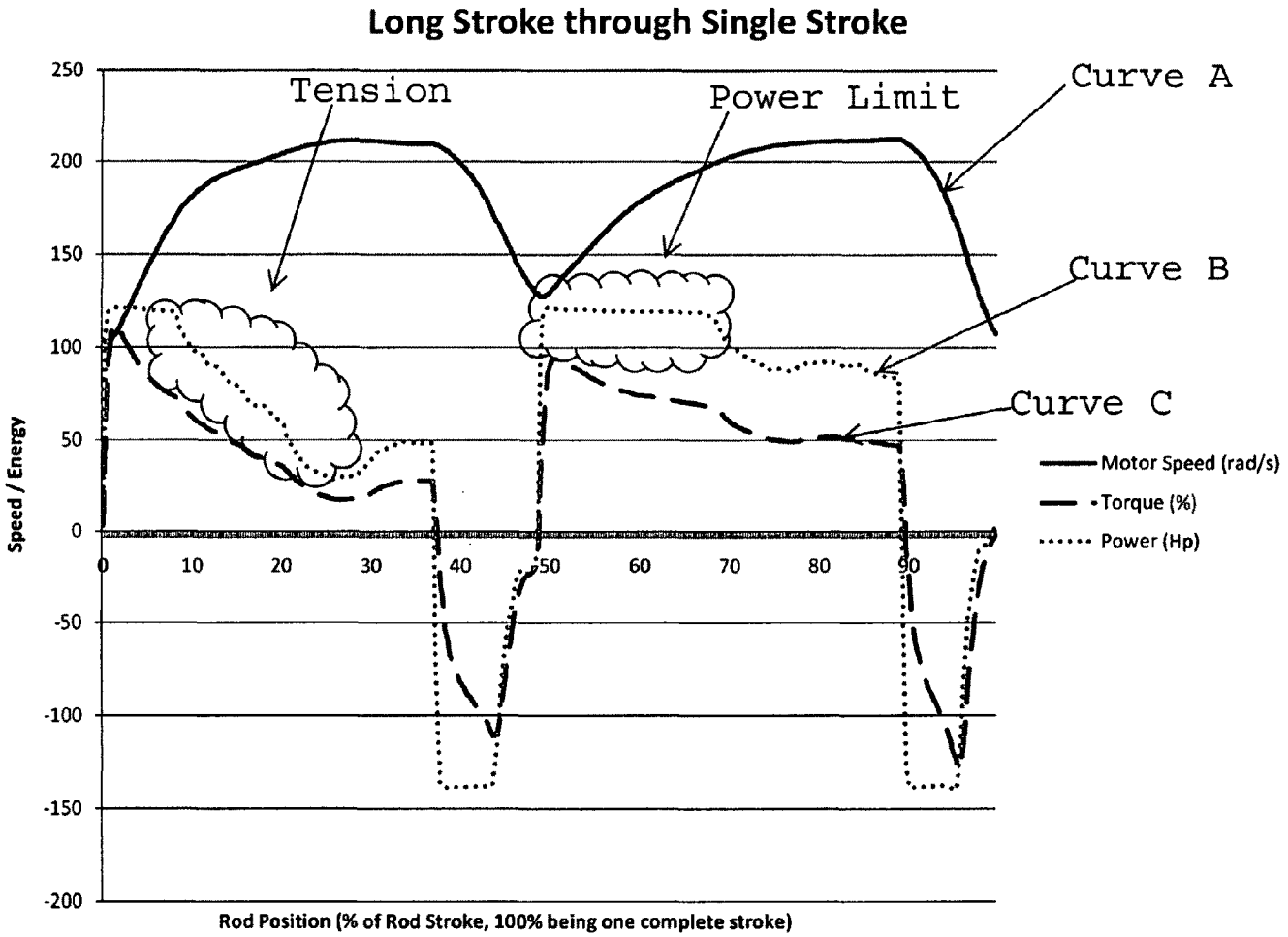
FIG. 5A is a graph showing the instantaneous velocity of the motor for a long-stroke pumping unit over the course of a single stroke.

If the "speed" signal from the well manager unit WM indicates that the average speed of the motor M over the course of the stroke cycle should remain the same, for example, if the well conditions are as shown in FIG. 4B, the instantaneous velocity of the motor will be increased and decreased in a control manner as depicted by the Curves A, B and C of FIG. 5A. Curve A shows speed/energy along the Y axis and the rod position along the X axis as a percent of the stroke cycle (0% equals beginning of the cycle, 50% the end of the upstroke, and 100% the end of the cycle). Curve A shows that on the upstroke, from about 0% to about 15% of the stroke cycle, the motor's speed rapidly increases. From about 15% to about 40% of the stroke cycle the motor's speed, although still increasing, its rate of increase slows, so that at about 40% of the stroke cycle, the motor decelerates rapidly. This indicates braking of the motor M as the end of the upstroke is reached. At 50% of the cycle, the motor's speed is again rapidly increased on the downstroke from about 50% to about 60% of the stroke cycle. Then from about 60% to about 90% of the stroke cycle the motor's speed, although still increasing, its rate of increase slows, so that at about 90% of the stroke cycle, the motor decelerates rapidly. This indicates braking of the motor M as the end of the downstroke is reached. Curve B shows the horsepower of the motor M over the course of the stroke cycle, and Curve C shows the motor's torque over the course of the stroke cycle. Curves B and C illustrate that, on initiation of the upstroke, energy is rapidly transferred from the power grid PG to the motor M. Then as braking occurs, the motor acts as a generator and transfers energy to the power grid as indicated by the valleys B' and C', respectively of these curves, dipping below the X axis into the negative energy scale region along the Y axis. This indicates that energy is being transferred to the power grid PG. For as long as the "speed" signal indicates the same average motor speed, the Curves A, B and C will be the same each stroke cycle. If, however, the "speed" signal indicates a change in the average motor speed, the shapes of these curves are altered in accordance with the program of the microprocessor 10*a* for this new average speed.

The tension control circuit TCC is advantageously employed with the long-stroke pumping unit 100. In response to a signal provided at the output 50*c* of the integrator 50 indicating the end of a stroke cycle and the instantaneous velocity of the motor M, the position/tension map 70 calculates rod position over the course of the cycle and provides a corresponding "tension reference map" signal at its output 70*b*. Upon receiving the "tension" signal at its input 72*a* and the "tension reference map" signal at its input 72*b*, the PID loop controller 72 applies a "speed trim reference" signal to the input 58*a* of the adder 58 to modify the "scaled instantaneous speed reference" signal being applied to the input 60*a* of the motor controller 60. Thus, the motor's instantaneous velocity (V) over the course of each stroke cycle is constantly adjusted to optimize oil production and maximize the operational life of the pumping unit PU, taking into account the actual tension in the rod R over the course of the stroke cycle.

Beam Pumping Unit

The microprocessor 10*a* for the beam pumping unit 200 as depicted FIG. 2B only includes a speed control circuit SCC'. It does not employ a tension control circuit TCC; however, it may employ a suitable tension control circuit TCC modified as required for a beam type pumping unit. The speed control circuit SCC' includes an integrator 50', a comparator 52', a position/speed map 54', a multiplier 56', and the motor controller 60. The comparator 52' has an input 52*c*' connected to an output 50*c*' of the integrator 50', an output 52*a*' connected to an input 54*a*' of the position/speed map 54', and an output 52*b*' connected to an input 60*b*' of the motor controller 60. The speed control circuit SCC' functions in essentially the same way as discussed above in connection with the speed control circuit SCC, except the actual tension in the rod R is not measured or used to modify or "trim" the motor's instantaneous velocity (V).

Figure 5B:
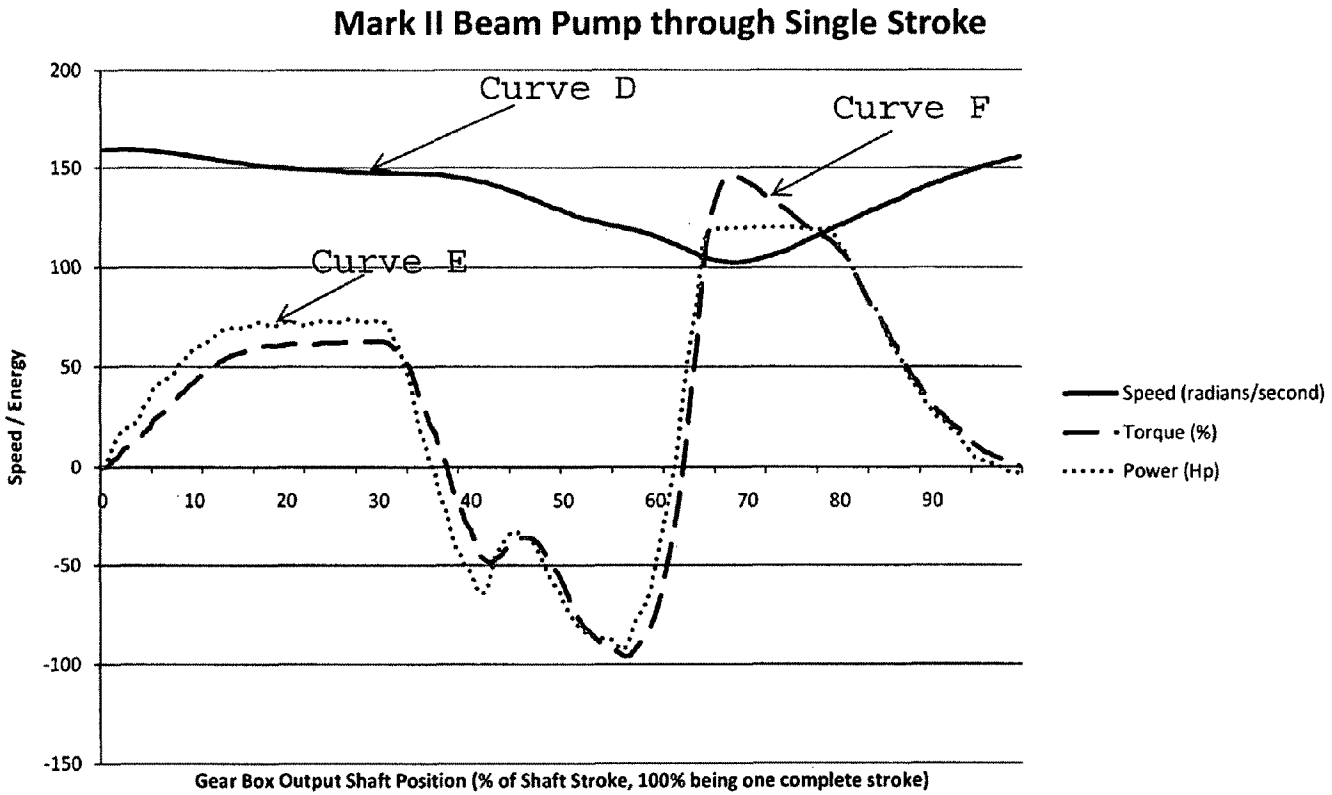
FIG. 5B is a graph showing the instantaneous velocity of the motor for a beam pumping unit over the course of a single stroke.

As shown in FIG. 5B, the instantaneous velocity (V) is controlled in a different fashion for the beam pumping unit 200 than the long-stroke pumping unit 100. If the "speed" signal from the well manager unit WM indicates that the average speed of the motor M over the course of the stroke cycle should remain the same, for example, if the well conditions are as shown in FIG. 4B, the instantaneous velocity of the motor will be increased and decrease in a controlled manner as depicted by the Curves D, E and F of FIG. 5B. Curve E shows the horsepower of the motor M over the course of the stroke cycle, and Curve F shows the motor's torque over the course of the stroke cycle.

Curve D shows speed/energy along the Y axis and the rod position along the X axis as a percent of the stroke cycle (0% equals beginning of the cycle, 50% the end of the upstroke, and 100% the end of the cycle). Curve D is very different than speed Curve A for the long-stroke pumping unit 100. In the case of the beam pumping unit 200 the instantaneous velocity (V) is at its highest instantaneous velocity at the initiation of the upstroke (0% of the stroke cycle) and gradually decreases to its slowest instantaneous velocity at about 60% of the stroke cycle. The motor's instantaneous velocity (V) then gradually increases to again attain its highest instantaneous velocity (V) at 100% of the cycle.

Curves E and F illustrate that, on initiation of the upstroke, energy is rapidly transferred from the power grid PG to the motor M as the stroke cycle proceeds between 0% and about 10% of the cycle. Then there is a leveling off of energy transfer from the power grid PG to the motor M between about 10% and about 30% of the cycle. The declining slop of the Curves E and F between about 30% and about 50% of the cycle, dipping below the X axis into the negative energy scale region along the Y axis, indicates that braking occurs and the motor M acts as a generator and transfers energy to the power grid PG. With the rod R reversing its direction of movement at 50% of the cycle, energy is again rapidly transferred from the power grid PG to the motor M. For as long as the "speed" signal indicates the same average motor speed, the Curves D, E and F will be the same each stroke cycle. If, however, the "speed" signal indicates a change in the average motor speed, the shapes of these curves are altered in accordance with the program of the microprocessor 10*a* for this new average speed.

Circuit Design

Figure 6B:
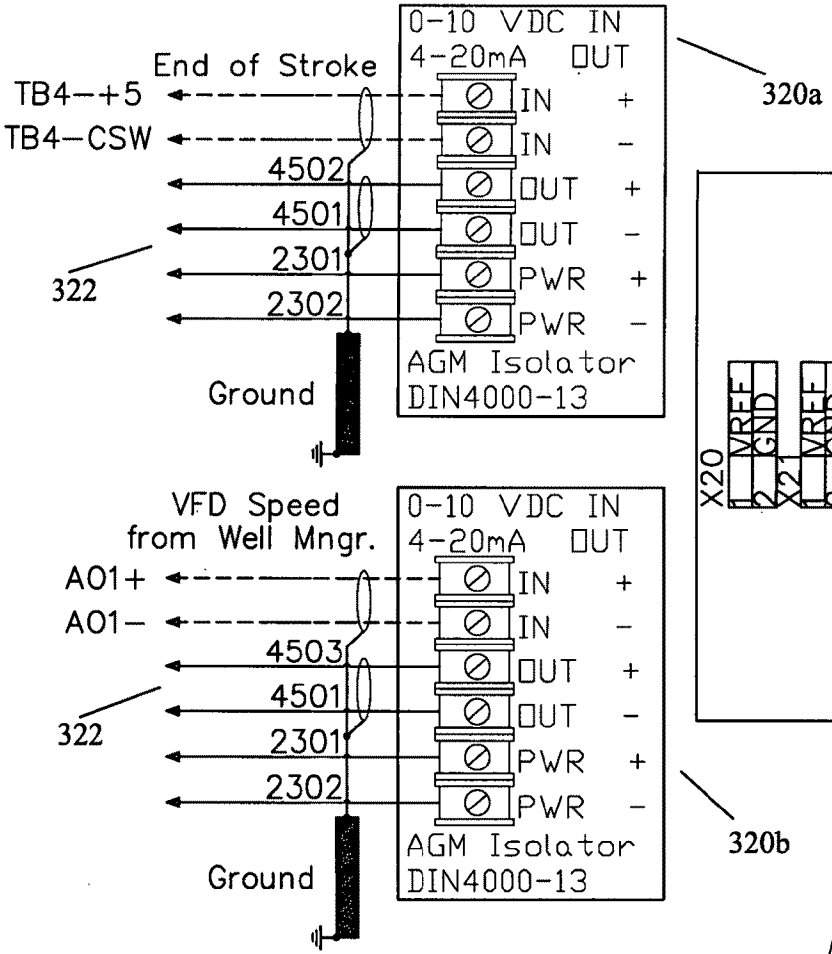
FIGS. 6A, 6B and 6C taken together represent a simplified wiring diagram of the control circuit for our control device.
Figure 6A:
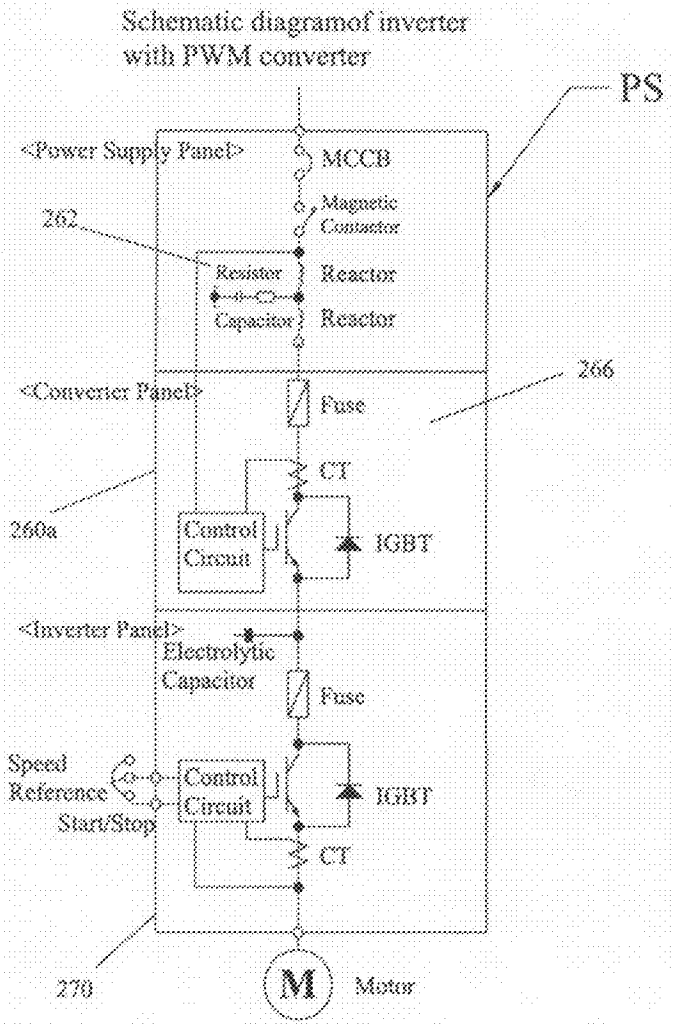

As depicted in FIGS. 1 and 6A through 6B, a control circuit 260 (FIG. 6C) controls the operation of our control device 10.

As shown in FIG. 6A, the AC regenerative drive unit RDU includes a sub-circuit 260*a* that reduces low order harmonic current drawn from the power grid PG. This sub-circuit 260*a* controls the waveform of the input AC voltage and current to provide the sinusoidal waveforms illustrated in FIG. 7. The sub-circuit 260*a* has an inductive and capacitive filter 262 that reduces harmonic voltage distortion caused by switching of a converter circuit 266 directly to the input AC current. Some AC drives use a line converter employing diodes to form a line side bridge rectifier. The use of diodes in the line side rectifier results in current flow that is not uniform and characterized as non-linear. This non-linear current has associated with its harmonic current. Allowable levels of harmonic distortion are set forth in the IEEE Std 519-1992 (Jun. 15, 2004) publication. This is the established American National Standard (ANSI).

Figure 7:
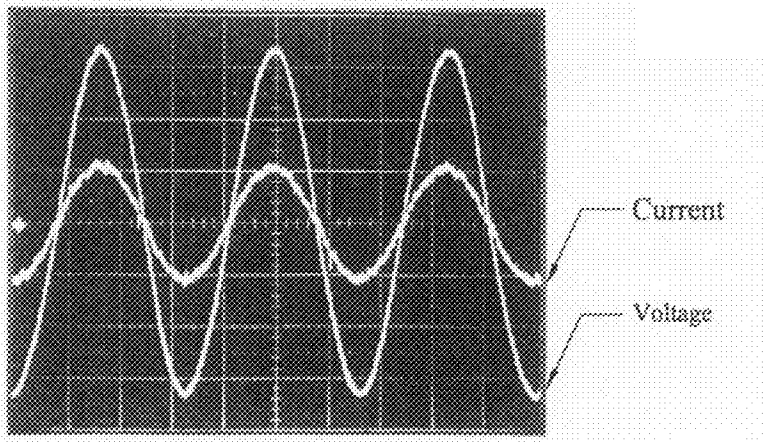
FIG. 7 is graph depicting input current and voltage waveforms.

The AC regenerative drive unit RDU equipped with the sub-circuit 260*a* meets the established American National Standard. The sub-circuit 260*a* has a DC power supply circuit PS1 connected to the low harmonic LCL filter 262. The output of the power supply circuit PS1 is connected to the converter circuit 266 employing high speed IGBT type transistors 268. The converter circuit 266 has its output connected to an inverter circuit 270 that also employs high speed IGBT type transistors 270*a*. The inverter circuit 270 has its output 272 connected to the motor M. The transistors 268*a* and 270*a* are switched on and off in such a manner that results in current flow and voltage that is nearly sinusoidal as shown in FIG. 7. The result is exceptionally low line harmonic content that is incompliance with the IEEE 519-1992 standard. Thus, our control device 10 does not require isolation transformers, phase shifting isolation transformers, or an additional external input filter for harmonic mitigation.

Figure 6C:
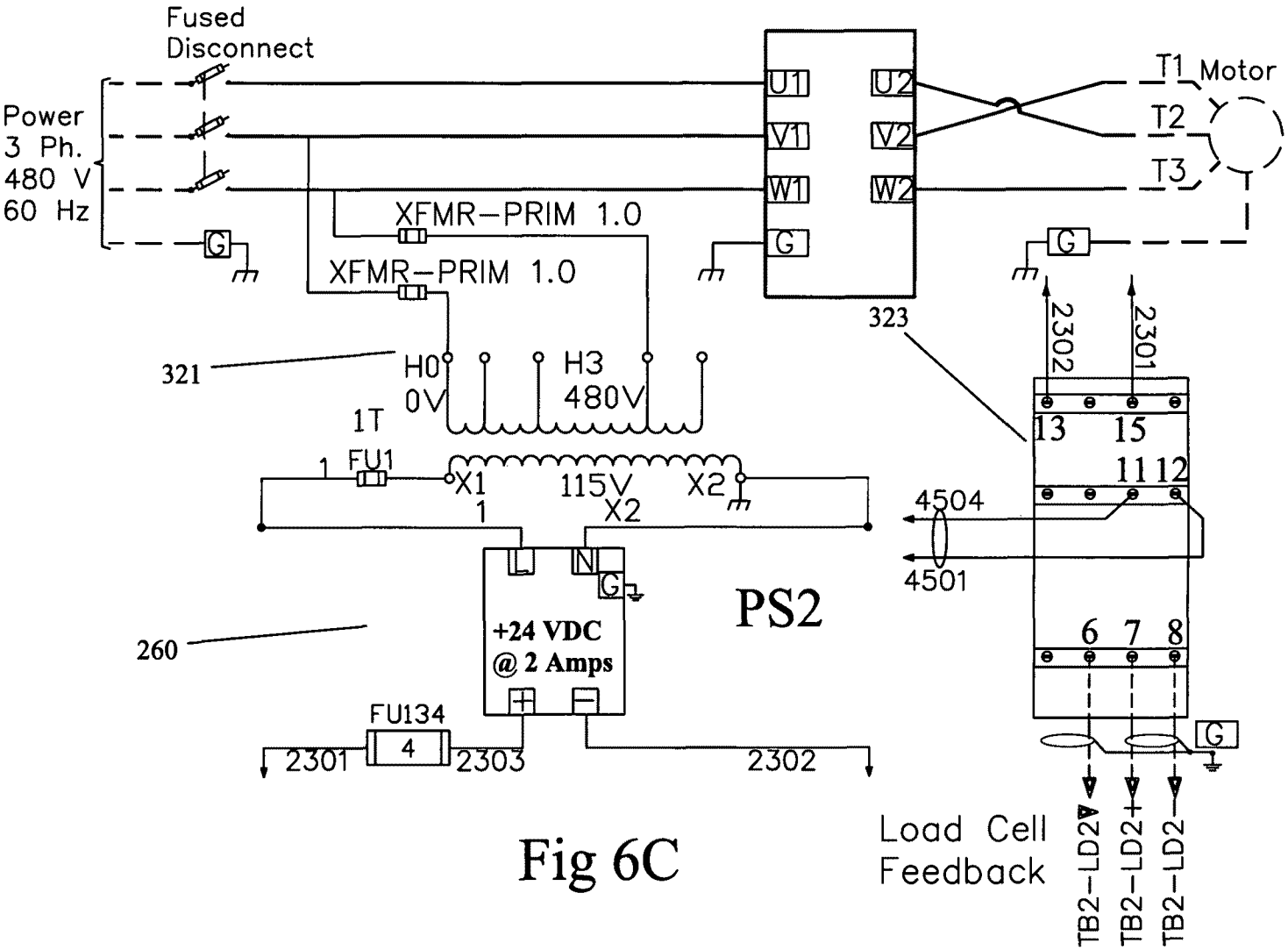

As shown in FIGS. 6A, 6B and 6C, the control circuit 260 includes a pair of isolators 320*a* and 320*b* (FIG. 6B) that suppresses noise, a DC power supply PS2 for the isolators coupled to a transformer 321 connected between the power grid PG through fused lines L1, L2 and L3 connected to the AC regenerative drive unit RDU, and an amplifier 323 for the tension signal. The isolators 320*a* and 320*b* are, respectively, in communication with the end of stroke signal and the speed signal provided by the well manager WM. The outputs 322 of the isolators 320*a* and 320*b* are connected to terminals 324*a* (FIG. 6C) of the microprocessor 10*a* as indicated by the identifying numerals 4501, 4502 and 4503.

The Appendices 1, 2 and 3 set forth programs for optimization of oil production and maximizing the operational life of the pump for the pumping units discussed above, and Appendix 4 is the manual used to program the microprocessor 10*a*. In accordance with conventional practices the programs called for in Appendices 1 through 3 are installed in the microprocessor 10*a*. Appendix 1 lists the parameters for the long-stroke pumping unit 100 that is has not been enabled to compensate for tension. Appendix 2 lists the parameters for the long-stroke pumping unit 100 that has been enabled to compensate for tension. Appendix 3 lists the parameters for the beam pumping unit 200. The programs enable the microprocessor 10*a*, through the control circuit 260, to drive the electrical motor M over the course of each stroke cycle at different speeds as a function of calculated the rod position, decreasing the motor speed by transferring electrical energy to the power grid and increasing the motor speed by transferring electrical energy from the power grid to the motor. In the Appendices 1, 2 and 3 under the heading Parameters, 84: ADAPTIVE PROGRAM and Parameters, 85: USER CONSTANTS lists are provided of the required parameters for varying speed in accordance with our method, indicating how to program the microprocessor 10*a* for pumping units 100 and 200 discussed above.

SCOPE OF THE INVENTION

The above presents a description of the best mode we contemplate of carrying out our method and control device for operating an oil well and oil well using our control device, and of the manner and process of making and using them, in such full, clear, concise, and exact terms as to enable a person skilled in the art to make and use. Our method and control device for operating an oil well and an oil well using our control device are, however, susceptible to modifications and alternate constructions from the illustrative embodiments discussed above which are fully equivalent. Consequently, it is not the intention to limit our method and control device for operating an oil well and oil well using our control device to the particular embodiments disclosed. On the contrary, our intention is to cover all modifications and alternate constructions coming within the spirit and scope of our method and control device for operating an oil well and an oil well using our control device as generally expressed by the following claims, which particularly point out and distinctly claim the subject matter of our invention:

The invention claimed is:

1. An oil well comprising a pumping unit including a rod extending below ground level into an oil well formation, an AC electrical motor that moves the rod through a stroke cycle having an upstroke and a downstroke, said motor being operably connected to the rod through a drive mechanism that operably connects the motor to the rod and rotates a drive shaft of the motor through a known number of revolutions with each stroke cycle, a first sensor that provides an end of stroke signal each time the rod is at an end of the downstroke during each stroke cycle of the rod, an AC drive that provides electrical energy from an AC power grid to the motor, said AC drive being capable of decreasing motor speed by transferring electrical energy to the power grid and increasing motor speed by transferring electrical energy from the power grid to the motor, a well manager control unit that controls the operation of the oil well in response to conditions of the oil well and provides for each stroke cycle of the rod a speed signal corresponding to an optimum average motor speed to maximize oil production under the then present well conditions, said AC drive being controlled by a microprocessor with an input at which the speed signal is received and an input at which the end of stroke signal is received, said microprocessor being programmed to vary the instantaneous velocity of the motor based on (i) the speed signal and (ii) a calculated position of the rod over the course of each stroke cycle, increasing and decreasing the motor speed to maximize fluid production and minimize tension in the rod on the upstroke and maximize tension in the rod on the downstroke, a determination of rod position being initiated each time said end of stroke signal is received, to set the motor at a predetermined minimum speed whenever the rod position indicates a rotation greater than said known number of revolutions and the end of stroke signal has not been received, and after setting the motor speed at said predetermined minimum speed and once again receiving the end of stroke signal, to vary the instantaneous velocity of the motor based on (i) the speed signal and (ii) a calculated rod position.

2. The oil well of claim 1 including a second sensor that monitors tension in the rod and provides a tension signal corresponding to the measured tension, and the microprocessor has an input that receives the tension signal and is programmed to take into account the measured tension in regulating motor velocity.

3. An oil well including a pump having a drive mechanism operably connected to an AC electric motor powered by AC electrical energy from a power grid, said motor moving a rod of the pump through a predetermined stroke cycle including an upstroke and a downstroke, a drive shaft of the motor being rotated to operate the drive mechanism to move the rod through a stroke cycle, a sensor that provides an end of stroke signal each time the rod is at an end of the downstroke during each stroke cycle of the rod, means for providing for each stroke cycle of the rod a speed signal corresponding to an optimum average motor speed to maximize oil production under the then present well conditions, and a variable frequency AC drive that controls the AC electrical energy in the motor to decrease motor speed by transferring the electrical energy to the power grid and to increase motor speed by transferring the electrical energy from the power grid to the motor, and said variable frequency AC drive including a microprocessor programmed (a) to vary the instantaneous velocity of the motor based on (i) the speed signal and (ii) a calculated position of the rod over the course of each stroke cycle, increasing and decreasing the motor speed to maximize fluid production and minimize tension in the rod on the upstroke and maximize tension in the rod on the downstroke, a determination of rod position being initiated each time said end of stroke signal is received, and (b) to set the motor at a predetermined minimum speed whenever the rod position indicates a rotation greater than said known number of revolutions and the end of stroke signal has not been received, and after setting the motor speed at said predetermined minimum speed and once again receiving the end of stroke signal, to vary the instantaneous velocity of the motor based on (i) the speed signal and (ii) a calculated rod position.

4. An oil well including a pump having a drive mechanism operably connected to an AC electric motor powered by AC electrical energy from a power grid, said motor moving a rod of the pump through a predetermined stroke cycle including an upstroke and a downstroke, a drive shaft of the motor being rotated through a known number of revolutions with each stroke cycle, a variable frequency AC drive that controls the AC electrical energy in the motor to decrease motor speed by transferring the electrical energy from the motor to the power grid and to increase motor speed by transferring the electrical energy from the power grid to the motor, and means for providing an end of stroke signal upon completion of each stroke cycle of the rod, means for providing for each stroke cycle of the rod a speed signal corresponding to an optimum average motor speed to maximize oil production under the then present well conditions, and said variable frequency AC drive including a microprocessor programmed (a) to vary instantaneous velocity of the motor based on (i) the speed signal and (ii) a calculated position of the rod over the course of each stroke cycle, increasing and decreasing the motor speed to maximize fluid production and minimize tension in the rod on the upstroke and maximize tension in the rod on the downstroke, a determination of rod position being initiated each time said end of stroke signal is received, and (b) to set the motor at a predetermined minimum speed whenever the rod position indicates a rotation greater than said known number of revolutions and the end of stroke signal has not been received, and after setting the motor speed at said predetermined minimum speed and once again receiving the end of stroke signal, to vary the instantaneous velocity of the motor based on (i) the speed signal and (ii) a calculated rod position.

* * * * *